US006839924B2

(12) United States Patent
Sims

(10) Patent No.: US 6,839,924 B2
(45) Date of Patent: Jan. 11, 2005

(54) BLANKET AND METHOD FOR SWADDLING AN INFANT

(75) Inventor: Henley Green Sims, Austin, TX (US)

(73) Assignee: Simple Swaddle LLC, Austin, TX (US)

( * ) Notice: Subject to any disclaimer, the term of this patent is extended or adjusted under 35 U.S.C. 154(b) by 0 days.

(21) Appl. No.: 10/368,805

(22) Filed: Feb. 14, 2003

(65) Prior Publication Data

US 2004/0158925 A1 Aug. 19, 2004

(51) Int. Cl.[7] ..... A47G 9/08

(52) U.S. Cl. ..... 5/494; 5/413 R; 5/655; 2/69.5

(58) Field of Search ..... 2/69, 69.5; 5/413 R, 5/655

(56) References Cited

U.S. PATENT DOCUMENTS

| | | | | | |
|---|---|---|---|---|---|
| 2,227,751 | A | * | 1/1941 | Idelman | 2/69.5 |
| 3,739,399 | A | | 6/1973 | Sheahon | |
| 4,611,353 | A | | 9/1986 | Als | |
| 4,616,365 | A | * | 10/1986 | Lyons | 2/69 |
| 4,897,885 | A | * | 2/1990 | Lunt | 2/69.5 |
| 4,979,250 | A | | 12/1990 | Troncone | |
| 5,046,204 | A | | 9/1991 | Mohler | |
| 5,129,406 | A | | 7/1992 | Magnusen | |
| 5,611,095 | A | | 3/1997 | Schneider | |
| 5,722,094 | A | * | 3/1998 | Ruefer | 2/69.5 |
| 5,735,004 | A | * | 4/1998 | Wooten et al. | 5/502 |
| D395,188 | S | | 6/1998 | Rush | |
| 5,852,827 | A | | 12/1998 | Lear | |
| D407,258 | S | | 3/1999 | Swink | |
| 6,009,576 | A | * | 1/2000 | Gramme et al. | 5/413 R |
| 6,269,502 | B1 | | 8/2001 | Ekstrom | |
| 6,341,397 | B1 | | 1/2002 | Kliegl | |
| 6,393,612 | B1 | | 5/2002 | Thach | |
| 6,640,340 | B2 | * | 11/2003 | Gibson | 2/69.5 |

* cited by examiner

*Primary Examiner*—Michael Trettel
(74) *Attorney, Agent, or Firm*—Rick B. Yeager

(57) ABSTRACT

An infant swaddle blanket having a central receiving section with a fitted upper edge for engaging the infant's neck and shoulders; a first flap from one side of the central section; a tongue extending from the upper portion of the first flap; and a second flap extending from the opposite side of the central section, a skid-resistant material on its bottom surface. An improved fit is provided through the infant's shoulders with curved shoulder seams and long elastic seams on the top edge of the blanket. The infant is placed backside down on the central section with a first arm against its side; the first flap is wrapped over the infant's right arm and torso; the tongue is tucked around the infant's second side, under the armpit and across the infant's back; the infant's second arm is placed next to its side; the second flap is wrapped over the second arm, torso, and first flap and secured to the first flap with hook and loop fasteners.

22 Claims, 11 Drawing Sheets

BLANKET AND METHOD FOR SWADDLING AN INFANT

BACKGROUND OF THE INVENTION

1. Field of the Invention

The present invention relates to a blanket and method for wrapping or swaddling an infant.

2. Discussion

Wrapping or swaddling an infant is believed to improve the baby's comfort, such as by simulating the way a baby would feel in its mother's womb or arms. Swaddled babies are believed to be calmer than infants that are not swaddled.

Conventional rectangular baby blankets can be used to wrap an infant, but those conventional blankets have a number of limitations including an excess of material which can cause overheating or discomfort, difficulty in properly folding the blanket to achieve a good wrap, lack of good fit around the infant's neck and shoulders, lack of ability to inspect a diaper without unwrapping the infant, lack of a closure to maintain the wrap, and a relatively smooth back surface which makes it difficult to safely handle a wrapped infant.

Swaddle blankets, other baby blankets, and baby sleeping bags are shown in prior art devices for keeping young babies and infants warm and secure.

U.S. Pat. No. 6,415,442 to Smith on Jul. 9, 2002 describes an infant wrap having a quadrangular, generally bilaterally symmetrical sheet of fabric material, with overlapping upper and lower flaps and fabric sleeves.

U.S. Pat. No. 6,393,612 issued to Thach, et al. on May 28, 2002 describes a swaddling garment including an elongated shell and a pair of internal restraints for receiving the arms of the baby.

U.S. Pat. No. 6,341,397 to Kliegl, et al. on Jan. 29, 2002 describes a baby wrapping blanket having a generally pentagonal shape.

U.S. Pat. No. 6,269,502 to Exstrom on Aug. 7, 2001 describes a method and apparatus combining pacifier, pacifier holder and swaddling blanket for extended pacification of infants.

U.S. Pat. No. 5,852,827 to Lear on Dec. 29, 1998 describes a baby wrapping blanket with side flaps and a slit. The first side flap is configured to be wrapped around the infant, inserted through the slit and secured to the outer surface. The second side flap is configured to be wrapped around the infant and over the previously folded first side flap.

U.S. Pat. No. 5,722,094, issued to Ruefer, on Mar. 3, 1998 discloses an infant swaddling apparatus defining a pocket that is closed on the sides and bottom, a hood, and hook-and-loop material for closing the pocket around an infant to retain body heat.

U.S. Pat. No. 5,611,095 issued to Schneider on Mar. 18, 1997 discloses a multifunction baby wrap which converts to a blanket, a bunting, a pad, a fitted wrap, or a shoulder wrap. It is adaptable for use with a child's car seat which is fitted with a restraint system, a front or back carrying pack for carrying infants or toddlers, a stroller or walker, a swing or jumping unit which contains a child, a grocery cart, a high chair, or like equipment in which the infant's legs must be separated. U.S. Pat. No. 5,129,406 issued to Magnusen et al. on Jul. 14, 1992 discloses an infant garment with crossed over arm positioning sleeves, particularly for premature and drug addicted infants, that is comprised of a saclike body with two extended sleeves that cross over each other, wrap around the child, and then attach in the back. The garment is designed to allow for passage of test leads and tubes through the opening in the front of the garment while the garment remains closed.

U.S. Pat. No. 5,046,204 issued to Mohler on Sep. 10, 1991 discloses a wrapping article having a generally triangular left-hand slide flap, a generally triangular right-hand side flap, first and second booties or stocking feet, and a hood. The article includes strips of hook and loop fabric for releasably securing the side flaps together when they are in the overlapped condition.

U.S. Pat. No. 4,979,250 issued to Troncone, et al. on Dec. 25, 1990 of an upper portion having two symmetric wings so that opposing corners of the lower panel can be wrapped around and behind the infant, leaving the infant snugly encapsulated within the multiple layers of the blanket with no excess accumulation or bagging of material.

U.S. Pat. No. 4,897,885, issued to Lunt on Feb. 6, 1990 discloses a one-piece infant bunting formed from a single blank of multi-layer fabric with a thermal insulation core layer, a hood section, and hook-and-loop fasteners.

U.S. Pat. No. 4,611,353 issued to Als et al. on Sep. 16, 1986 discloses an infant garment having a sack portion adapted to receive the legs of an infant, and two flaps to wrap around the arms and overlap behind the body.

U.S. Pat. No. 373,939, issued to Sheahon on Jun. 19, 1973 discloses a neonatal wrap of a plastic sheet with a series of flaps on each side of the sheet, a foot pocket, and a hood. The flaps, foot pocket, or hood may be selectively folded back for access to the infant.

U.S. Design Pat. No. 395,188 issued to Rush on Jun. 16, 1998 shows a nursing/receiving blanket.

U.S. Design Pat. No. 407,528 issued to Swink on Mar. 30, 1999 shows a baby bundler blanket.

SUMMARY OF THE INVENTION

The current invention includes embodiments of a swaddle blanket which reduce overheating in a swaddled infant by providing a minimal amount of lightweight breathable material with improved fit features. In various embodiments, the improved fit features include curved shoulder seams, tapered upper edges, elasticized upper edges, a profiled tongue for wrapping around the infant's first arm and under the second armpit, and selectable leg section closures. Through one or more of the improved fit features, a swaddle may be achieved which is functional, in that it secures the arms by the infant's sides, without being too tight. In addition to the reduction in overheating, the leg section provides room for leg movement, which is believed to be beneficial in hip socket development.

One embodiment of the current invention is a lightweight breathable blanket having a central receiving section for engaging the infant's neck and shoulders with flaps on either side of the central receiving section. The central section includes curved shoulder seams. The first flap is longer than the second flap, and is wrapped partially around the infant. The second flap is wrapped across the first flap, and its upper portion is secured with a hook and loop fastener to the upper portion of the first flap.

One embodiment of the current invention is an asymmetrical lined cotton lightweight, breathable, blanket which has a minimal amount of surface area to achieve a secure swaddle around an infant. In a right-handed example of this embodiment, the blanket has a central receiving section for engaging the infant's neck and shoulders, a first flap to the left of the central section, a tongue extending from the upper left side of the first flap, and a second flap extending to the right of the central section.

The invention further includes a method for wrapping the infant in the blanket. In the right-handed example, a right-handed mother places the infant backside down on the central section; places the infant's right arm against the infant's right side; wraps the first flap over the infant's right arm and torso; tucks the tongue around the infant's left side, under the armpit and across the infant's back; places the infant's left arm next to the left side; wraps the second flap over the left arm, torso, and first flap; and secures the second flap to the first flap with hook and loop fasteners.

In a similar left-handed example, a mirror image blanket and method are provided.

Other embodiments of the blanket include a single layer of material, two layers of material such as a decorative outer layer and a soft inner layer, and a variety of materials such as flannel, fleece, or cotton.

Other embodiments include lower fastening means independent of the flap fastening and elastic edges on the lower portion of the central section and left flap to facilitate the gathering of the lower edges to form either a loose or relatively tight closure of the lower portion of the swaddle.

Other embodiments include improved fit features such as a crewed neck, a v-neck, elasticized top edges which engage the infant's shoulders, curved shoulder seams where his shoulders meet the blanket edge to facilitate proper positioning and wrapping.

Other embodiments include a variety of fastening means such as snaps, ties, or hook and loop fasteners; and a plurality of fastening positions relative to the second flap and first flap in order to permit swaddling of different sizes of infants.

Other embodiments include incorporation of a skid-resistant material on at least a portion of the underneath side of the central section to facilitate safer handling of the swaddled infant.

Other embodiments include fastening means such as hook and loop fasteners on the sides of the swaddled infant to engage side roll restraints to restrict the ability of the swaddled infant to roll onto her side or back.

Variations and equivalent arrangements of the invention will be obvious to those skilled in the art and are to be considered to be within the scope and spirit of the invention as set forth in the claims.

DETAILED DESCRIPTION OF THE EMBODIMENT

Figure 1A:
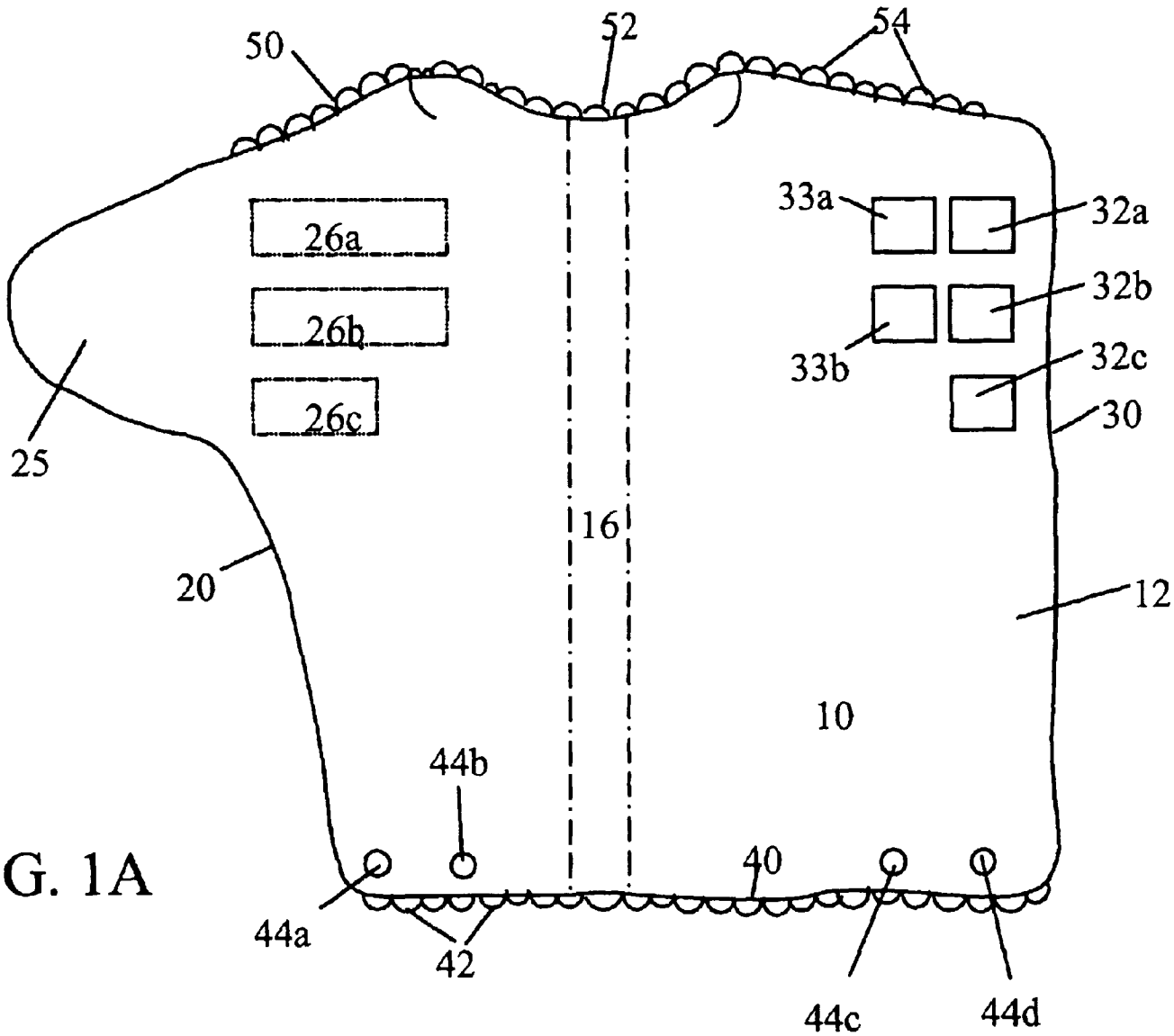
FIG. 1A is a top view of the inner surface of an unfolded blanket of one embodiment of the invention.

Referring now to FIG. 1A, which is the inner surface 12 of an unfolded infant, swaddle blanket 10, in this example, the blanket has a continuous edge including top edge 50, a first edge side 20, and second side edge 30, and bottom edge 40. Although the blanket is shown as a flat article, elasticized edges and curved shoulder seams prevent the blanket from laying flat.

In this example, the top edge 50 includes a shallow crew neck 52 for engaging the back of an infant's neck. An elastic lining 54 is provided through the crew neck 52, in a portion of the top edge extending from the neck to the first side edge, and in a portion of the top edge extending from the neck to the first side edge. This elasticized region typically includes that portion of the upper edge between the outside of an infant's shoulders when an infant is positioned in the blanket.

The top edge may have various profiles including a slight downward taper in each direction from the neck as illustrated in FIG. 1, or straight extensions in either direction from the neck. In this embodiment, the first side edge includes a tongue 25 which is used to wrap over the infant's torso and behind the infant's back as described below. In other embodiments, the first side edge may be the angled or straight edge of a flap which wraps around the infant's torso.

In this embodiment, a first set of three hook and loop fastener segments 32*a*, 32*b* and 32*c* are inset from the second side edge 30. Further inset from the second side edge in this example are a second set of hook and loop fastener segments 33*a* and 33*b*. In other examples, the number, placement, and type of fastener means may be varied.

In this example the bottom edge 40 includes an elastic edge section 42 and snaps 43*a* and 43*b*; and 44*a* and 44*b*. In this example, the snap portions include a male or female portion affixed near one side of the bottom edge, and a corresponding female or male portion affixed near the other side of the bottom edge. Alternately, hook and loop fasteners or other fasteners means may be used to secure the lower portion of the wrapped blanket. The blanket typically includes decorative, breathable, cotton or other fabric material as an outside material and a breathable liner is used for the inner surface 12 as a lining material.

Figure 1B:
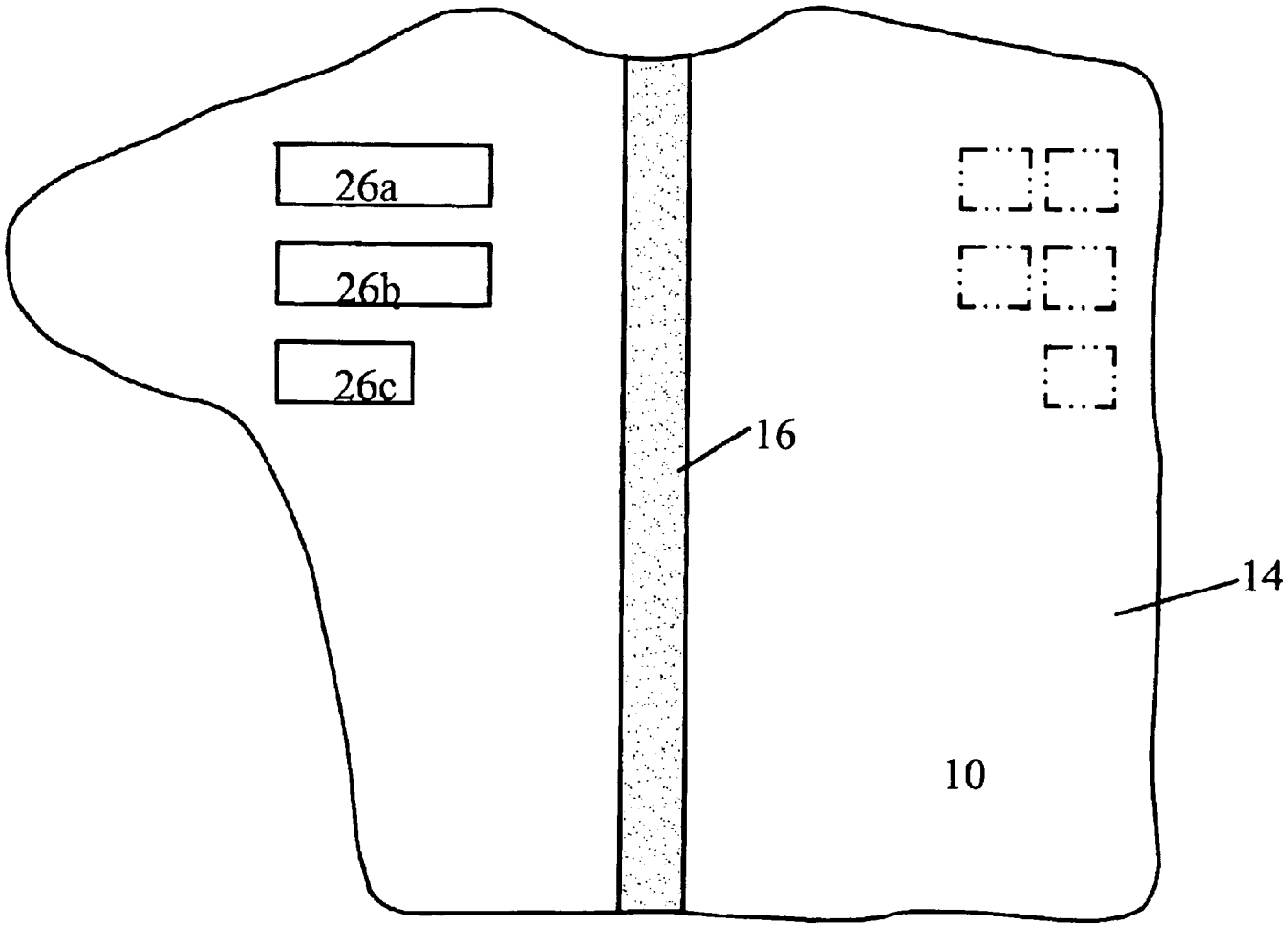
FIG. 1B is a top view of the outer surface of an unfolded blanket of one embodiment of the invention.

Referring now to FIG. 1B which is a top view of the outer side of an unfolded infant blanket 10, the bottom surface 14 typically comprises a decorative fabric. In this example, a strip of skid-resistant material 16 similar to that found on an infant pajama foot is provided. The skid resistant surface provides an improved grip when handling the baby. Also provided on the back side of the blanket or hook and loop fastener sections 26*a*, 26*b* and 26*c* which engage corresponding parts 32*a–c* or 33*a–b* respectively. The second set of fastener segments 33*a* and 33*b* permit the swaddle blanket to be wrapped snuggly around a smaller infant, while the second set 32*a–c* is for a larger infant.

Figure 1C:
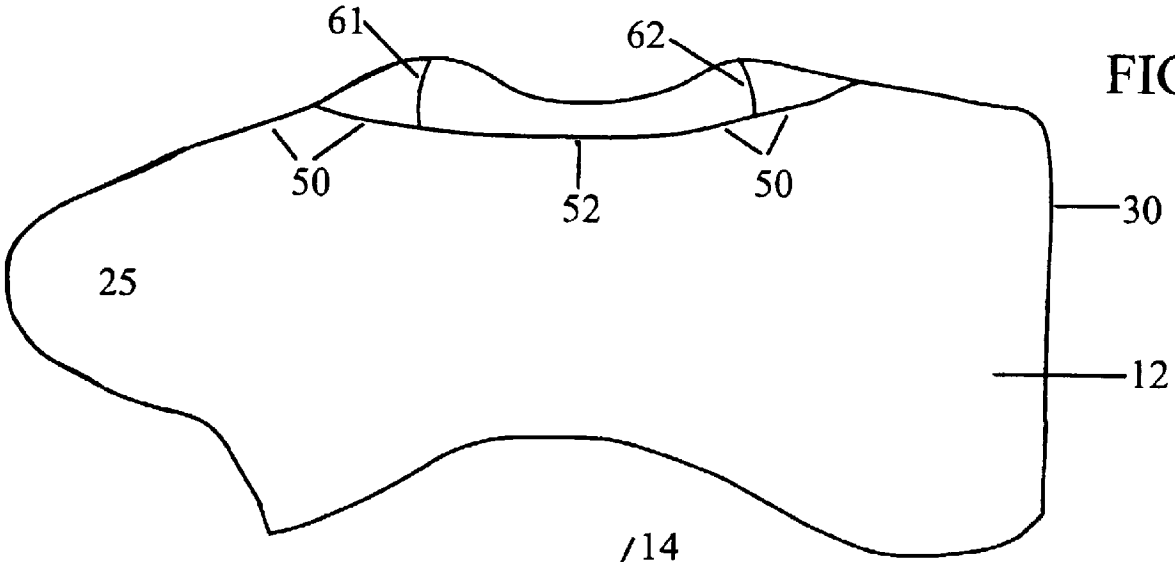
FIG. 1C is a top view detail of the upper portion of the blanket of FIG. 1 showing the curved shoulder seams and the elasticized upper edge.

Referring now to FIG. 1C, which is a detailed view of the top edge of the blanket, the top edge 50 of the blanket is shown upturned slightly in the middle of the blanket due to a first curved shoulder seam 61 and a second curved shoulder seam 62. These curved shoulder seams are positioned so that the top of each seam will be at the infant's shoulder, and so that the seam will extend partially down the infant's arm when the arm is placed beside the infant. In this example, the curved shoulder seams are approximately 3¼ inches long, and may be of shorter or longer length in other examples.

An elasticized neck region is provided in this example by elastic sewn or otherwise affixed within a hem of the blanket, with the elastic extending through the neck region in both directions approximately 75% of the distance between the curved shoulder pleats and the tongue or second side respectively. The combination of the elasticized neck region and the curved shoulder seams provides a secure fit around the infant's shoulders, and helps confine the infant's arms within the folded swaddle blanket without requiring that the swaddle be tight. By contrast, a flat blanket typically cannot be folded in such a way as to confine the arms reliably without the blanket being pulled tightly around the infant.

Figure 1E:
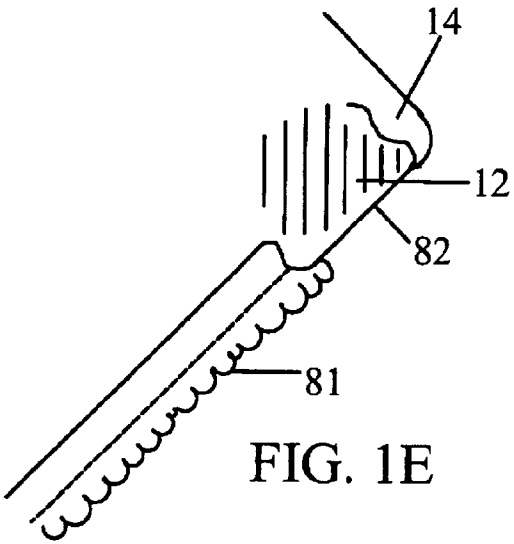
FIG. 1E is a perspective view detail illustrating elastic sewed inside of a hem.
Figure 1D:
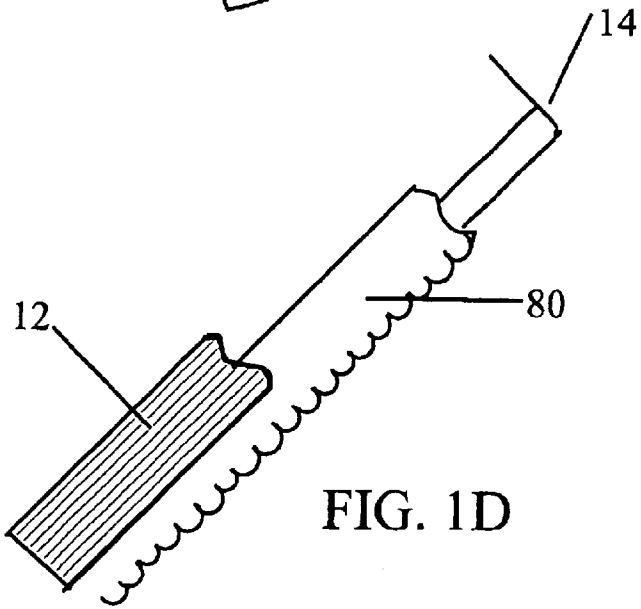
FIG. 1D is a perspective view detail illustrating elastic sewed between a liner layer and an outside layer.

Referring now to FIG. 1D, an example of elasticized edges include lingerie elastic 80 sewed between a first liner layer 12 and a second outside layer 14. Referring now to FIG. 1E, another example of an elasticized edge is an elastic 81 sewed on the inside hem of the liner layer 82 and the outside layer. An elastic may also be affixed to a single layer of material. In this example, the elasticized edges include the bottom edge and a portion of the top edge. In other embodiments, the blanket is provided with an elasticized top edge or bottom edge, or is provided without elasticized top or bottom portions.

Figure 2A:
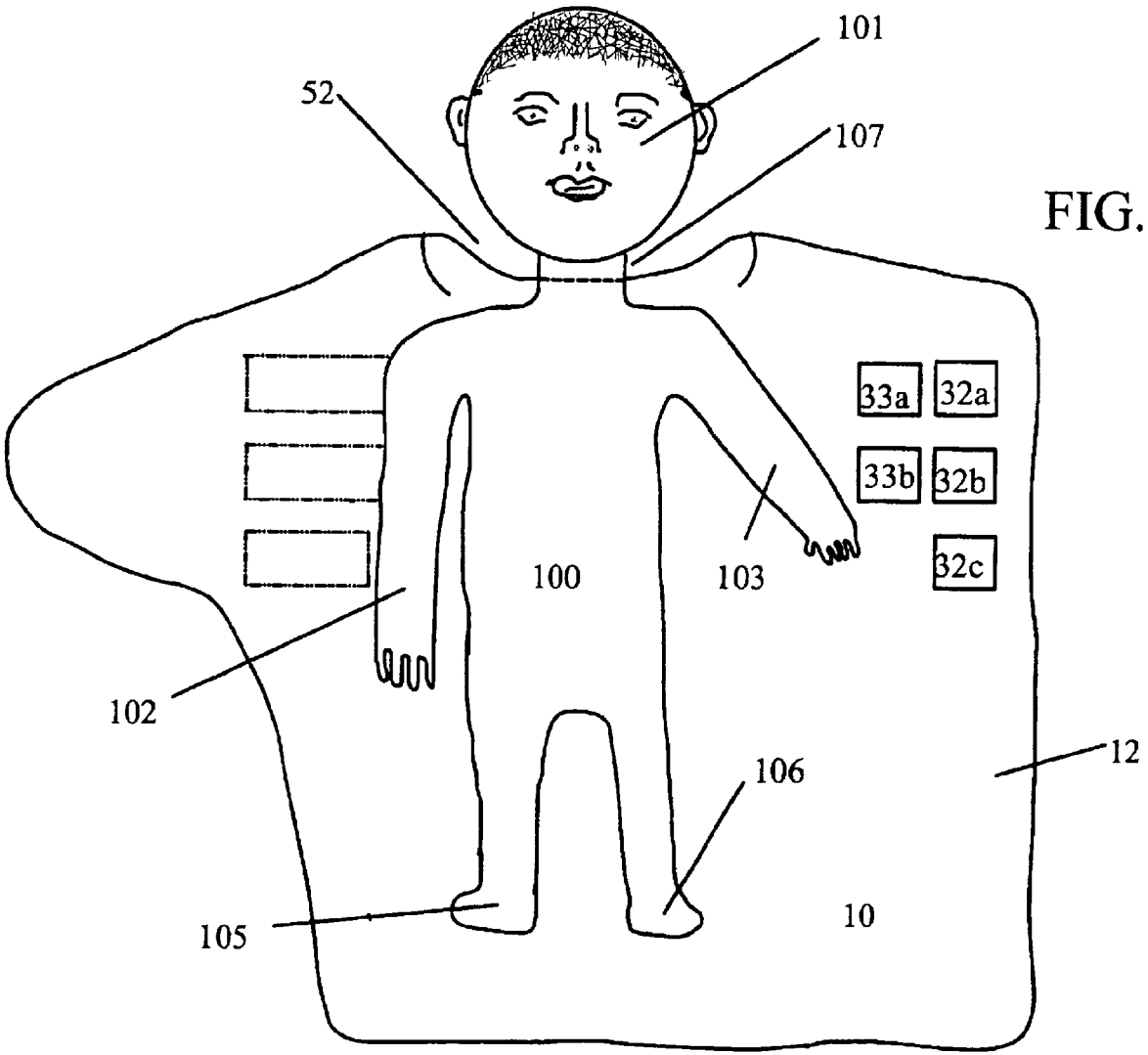
FIG. 2A is a top view of an infant positioned on the blanket of FIG. 1A.

Referring now to FIG. 2A which illustrates an infant 100 placed on the top surface 12 of the swaddle blanket 10. The infant has a head 101, a first arm 102, a second arm 103, a torso 104, a first leg 105, and a second leg 106. The baby is placed on the swaddle blanket such that the baby's neck 107 is over the crew neck notch 52 and is essentially oriented longitudinally on the blanket. The baby's first arm 102 is placed along side the baby's torso 104 while the second arm 103 is extended.

Figure 2B:
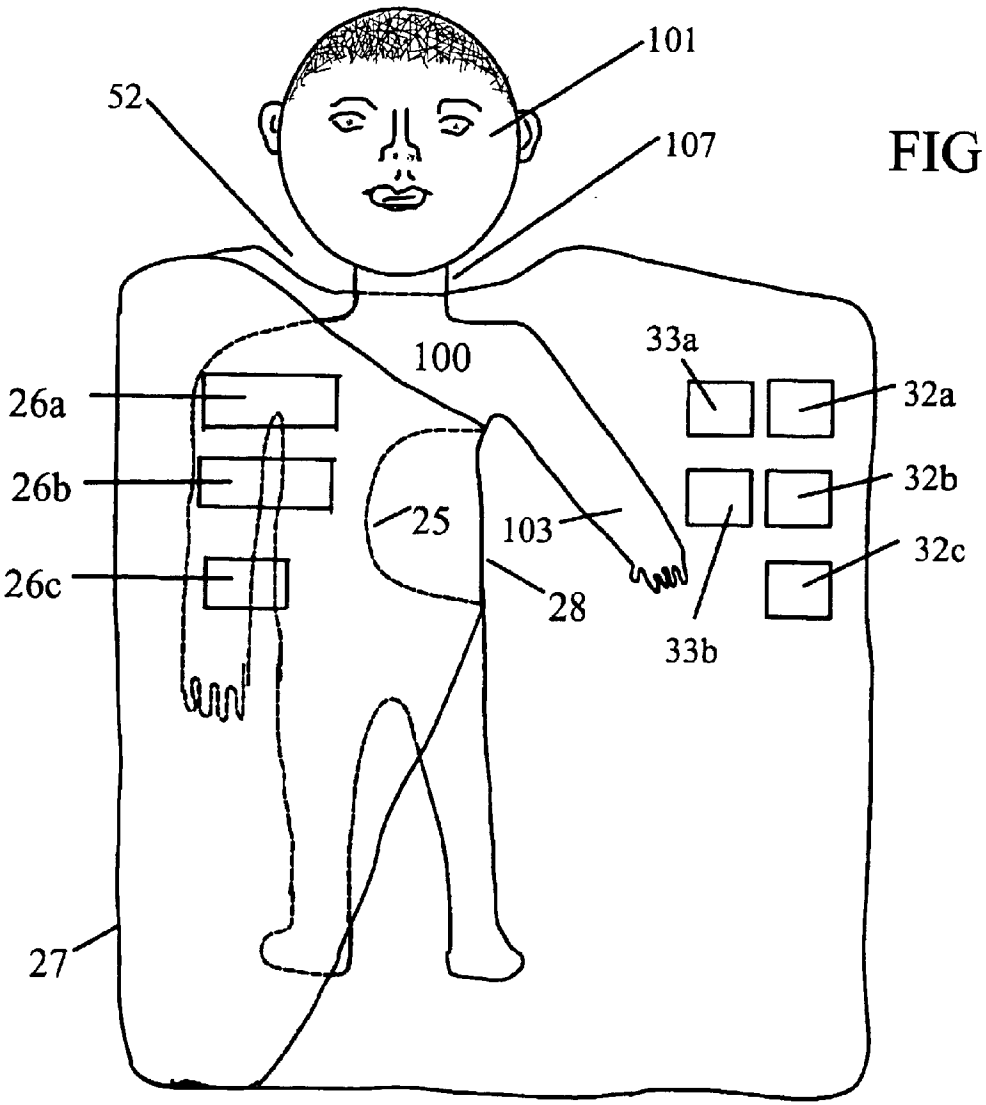
FIG. 2B is a top view of the embodiment of FIG. 2A with a first flap folded over the infant and a tongue tucked behind the infant.

Referring now to FIG. 2B, first side edge and in particularly the first side tongue 25 is wrapped under the baby's torso such that the baby's first arm 102 is contained by that portion of the wrap while the baby's second arm 103 is free. The figure illustrates the first side tongue 25 being partially underneath the infant while the fold creates a first folded edge 28 along the infant's torso under the second arm 103 and the fold creates a second folded edge 27, which is a new first outside edge. The wrapping extends over the legs such as shown by FIG. 2B but does not necessarily confine the legs within the wrap. The hook and loop fastener section 32A through 32C and second optional set of fasteners 32A through 33C are also shown in the figure. More or fewer than three sections of hook and loop fastener may be provided. For instance the hook and loop fastener may be provided as a single straight of hook and loop material or may have a plurality of hook and loop materials. Generally the hook and loop fasteners will end at or above the baby's thigh in order to minimize the restrictions on the movement of the baby's hips and legs.

Figure 2C:
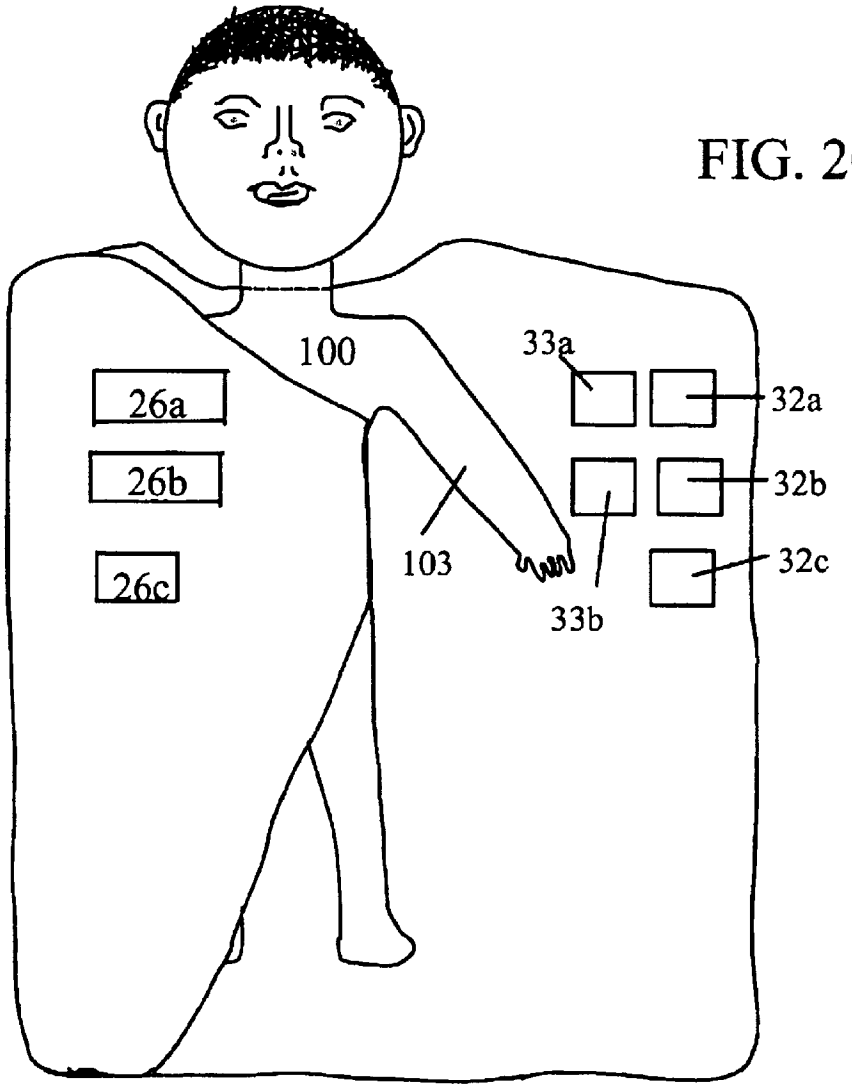
FIG. 2C is a top view of the embodiment of FIG. 2B with the infant's arm positioned by its side.

Referring now to FIG. 2C the baby's second arm 103 is placed by the baby's side.

Figure 2D:
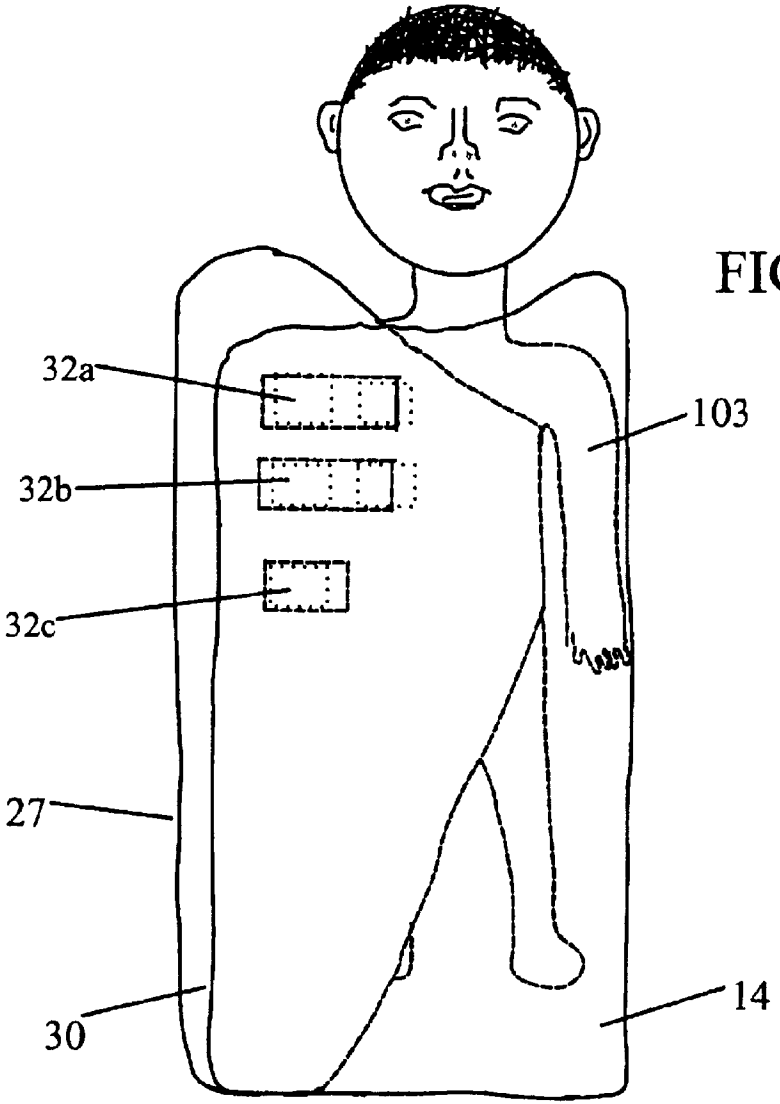
FIG. 2D is a top view of the embodiment of FIG. 2C with the second flap wrapped over the infant and secured.

Referring now to FIG. 2D the second edge is then wrapped around the baby's second arm 103 and fastened with one or more hook and loop fasteners as shown. One type of hook and loop faster is a first section of hook material and mates with a second section of loop material. Another type of hook and loop fastener includes both sections on a strap which is passed through a buckle and fastened back onto itself. In this way the baby is swaddled with the arms by the baby's side.

DETAILED DESCRIPTION OF EMBODIMENT

Roll Restriction

The swaddled baby may be placed between roll restriction devices such as wedged type bumpers to restrain the baby from turning on the baby's stomach so that the baby will remain on its back.

Figure 3B:
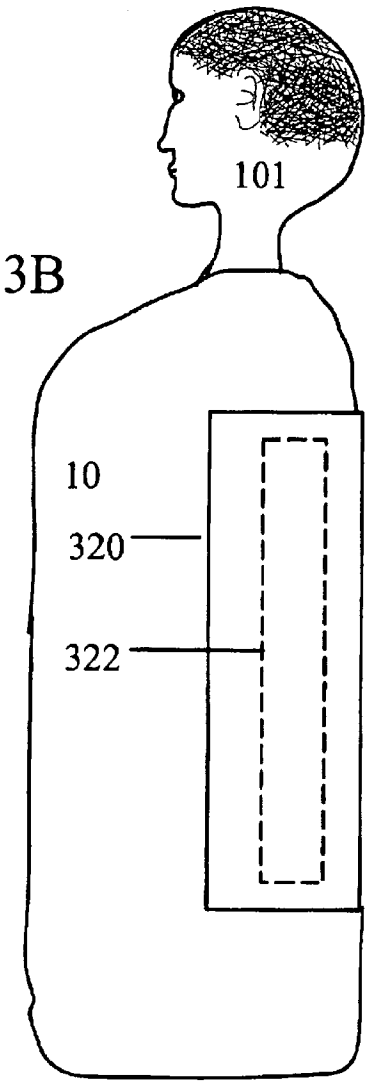
FIG. 3B is a side view of a swaddled infant and a roll restriction device.
Figure 3A:
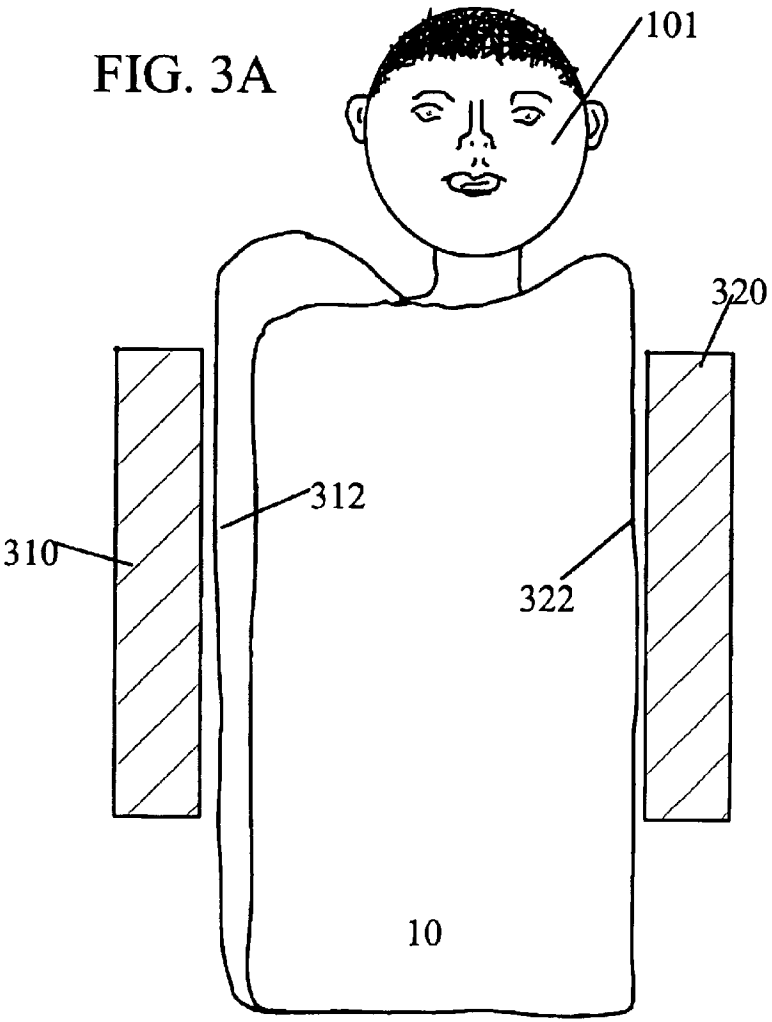
FIG. 3A is a top view of a swaddled infant illustrating roll restriction devices.

Referring now to FIG. 3A, wedges or other roll restriction devices 310 and 320 may be attached to the swaddle blanket by means of fasteners 312 and 322 such as a hook and loop fastener attached to the bottom fabric material of the blanket.

Referring now to FIG. 3B which is a left side view of a swaddled infant, a roll restriction device 320 is removably attached to a hook and loop fastener 322 on the side of the swaddle blanket. The hook and loop fastener 322 is on the bottom surface of the blanket and is exposed on the side after the second flap is wrapped over the infant.

DETAILED DESCRIPTION OF EMBODIMENT

Bottom Closure Snaps

In this example, the bottom of the swaddle blanket may be optionally secured by snaps or hook and loop fastener devices to provide a loose closure of the material. By providing separate closure means on the upper portion and the lower portion of the wrap, the bottom can be undone without unswaddling the baby, thereby permitting the infant to be placed in a car seat, and permitting access to check the infant's diaper.

DETAILED DESCRIPTION OF EMBODIMENT

Blanket Sections with Tongue

Referring now to FIG. 4A the swaddle blanket can be discussed in terms of sections of the blanket, which in this example include a tongue 210, a first flap 220, a receiving portion 240 and a second flap 260. The receiving portion 240 includes a top surface for receiving the infant, a top edge 241, a first side 242, a second side 243 and a bottom edge 244. In this example the sides 242 and 243 are continuous with adjoining regions and do not define external edges.

The first flap 220 includes a top edge 221, a first side 222, a second side 223 which is integral with the first side 242 of the receiving portion, and a bottom edge 224. In this example the top edge 241 is a gentle crew neck portion which is a shallow concave top edge. In this example, the top edge 221 of the first flap is slightly tapered between the second side 223 and the first side 222 of the first flap. In other examples, this top edge may have a different profile such as more tapered as shown in FIG. 1, or straight.

The tongue portion 210 is integral to the first side 222 of the first flap. In this example the tongue portion is a rounded member having a width approximately equal to the width of the first flap or slightly longer than the first flap. The tongue includes an external edge 215 which extends from the top edge 221 of the first flap to the bottom edge 224 of the first flap. In other examples the tongue may be rectangular, triangular, or other shapes.

The blanket also includes a second flap 260 which, in this example, has a slightly tapered top edge 261 extending from a first side 262 to a second edge 263. In other examples, this top edge may have a different profile such as more tapered as shown in FIG. 1, or straight. The second flap also includes a bottom edge 264 which extends from the second edge 263 to the bottom edge 244 of the receiving portion. This example, the receiving portion 240 is slightly larger than the width of the infant from outside of a first arm to the outside of a second arm when the infant is lying on the receiving section.

In this example, a right handed version is shown which is convenient for a right handed caregiver, such as a mother, to be able to tuck the tongue underneath the infant. In other examples a left handed asymmetrical blanket may be provided where the second side has a tongue and the first side is a mirror image of this embodiment.

In this example, the central receiving section is the area between the first curved shoulder seam 61 and the second curved shoulder seam 62, and extending downward to the bottom edge. As described above, the curved shoulder seams tend to prevent the blanket from laying flat, and the neck region and adjoining upper flap edges are curled above the other portions of the blanket.

DETAILED DESCRIPTION OF EMBODIMENT

Improved Blanket

In this embodiment a swaddle blanket is provided which is improved relative to prior art blankets.

Figure 4:
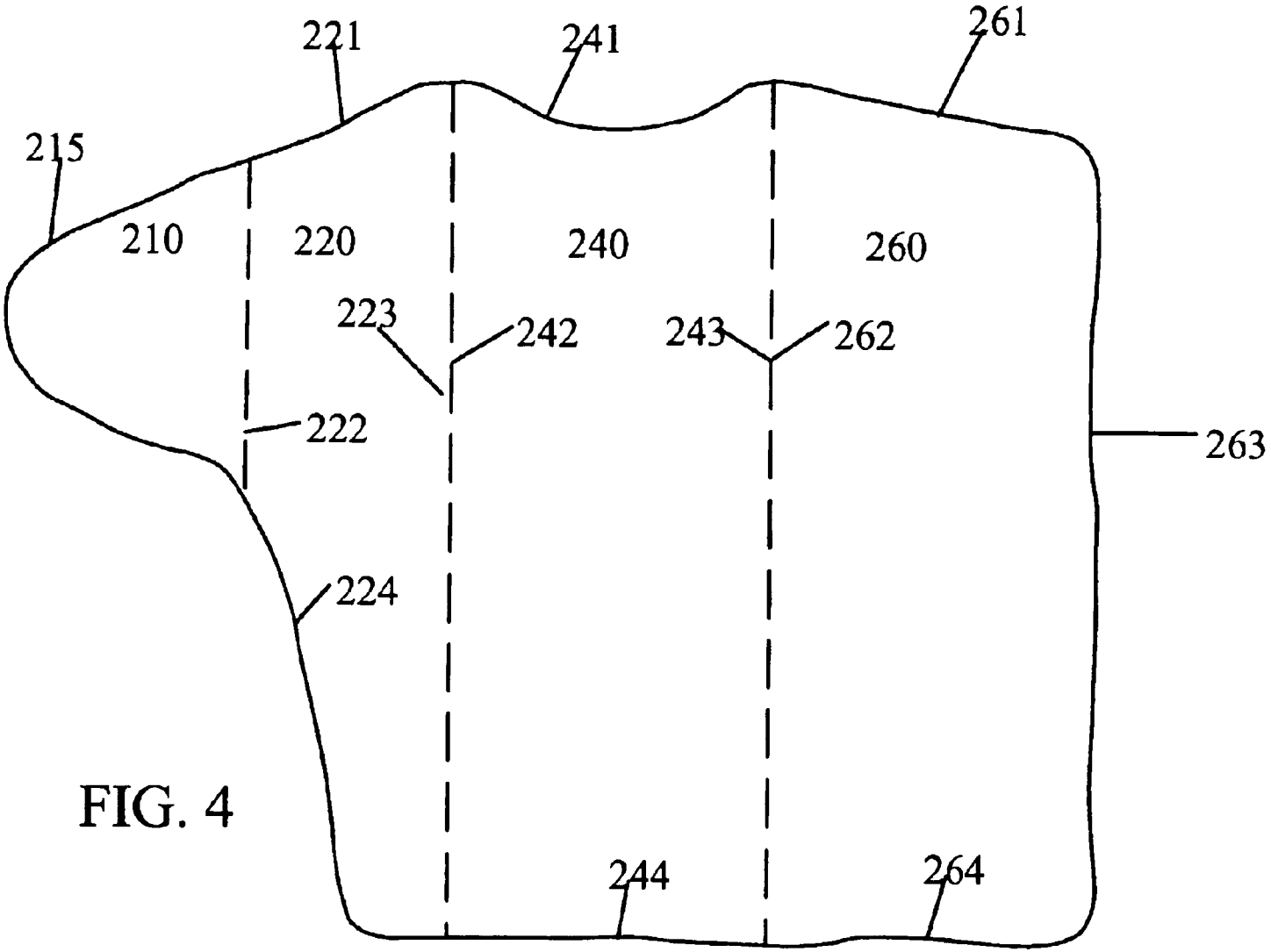
FIG. 4 is a top view of the inner surface of an unfolded blanket illustrating regions of a blanket with a central section, a first flap, a tongue, and a second flap.

One improvement relates to ease of use in swaddling an infant. The swaddle blanket, having a profile as described in FIG. 4, is unfolded so that an inner receiving layer is facing upwards. An infant is placed back down on the receiving blanket so that the infant's neck overlaps the top edge of the central section, and the infant's shoulders are positioned between the first curved shoulder seam and the second curved shoulder seam. These curved shoulder seams, along with the upper edge of the central section, are convenient reference points for efficient positioning of the infant. Once the infant is positioned, the tongue can be wrapped over the infant's first arm and tucked underneath the second armpit and behind the infant's back. The shape and position of the tongue facilitate an efficient first wrapping motion. The second flap is then overlapped the infant's second arm and the first flap; and conveniently placed hook and loop fastener sections permit efficient closure of the flaps. In this example, the shape of the swaddle blanket and the hook and loop closure permits a relatively easy swaddling of an infant.

A second advantage over prior art blankets is the reduction in potential overheating in a swaddled infant by providing a minimal amount of lightweight breathable material with improved fit features. These improved fit features contribute to reduced overheating in three ways. First, the fit features allow a blanket to be provided with less material so that a wrapped infant is surrounded by less material. Second, the fit features permit the infant to be wrapped less tightly than in conventional blankets, and still achieve an effective swaddle. Third, the swaddle may be left loose or loosely closed at the legs. In this embodiment, the improved fit features include curved shoulder seams, elasticized upper edges, a profiled tongue, and selectable leg section closures.

A third advantage over prior art blankets is that the loose leg section provides room for leg movement, which is believed to be beneficial in hip socket development.

A fourth advantage over prior art blankets is that, even if the leg section closures are used, the leg section may be undone without unwrapping the swaddle. Thus a swaddled infant's diaper may be checked, or a swaddled infant may be placed in a carseat without unswaddling the infant.

The blanket is provided in three sizes-small, medium, and large. The small blanket is 26 inches long, 34 inches wide at its widest point, and 10 inches wide between the curved shoulder seams. The medium blanket is 26 inches long, 36½ inches wide at its widest point, and 10 inches wide between the curved shoulder seams. The large blanket is 28 inches long, 41 inches wide at its widest point, and 10 inches wide between the curved shoulder seams. These blankets will be offered as Simple Swaddle™ blankets by Swaddle Sack, LLC of Austin, Tex.

DETAILED DESCRIPTION OF EMBODIMENT

Right-handed Wrapping Method

Figure 5:
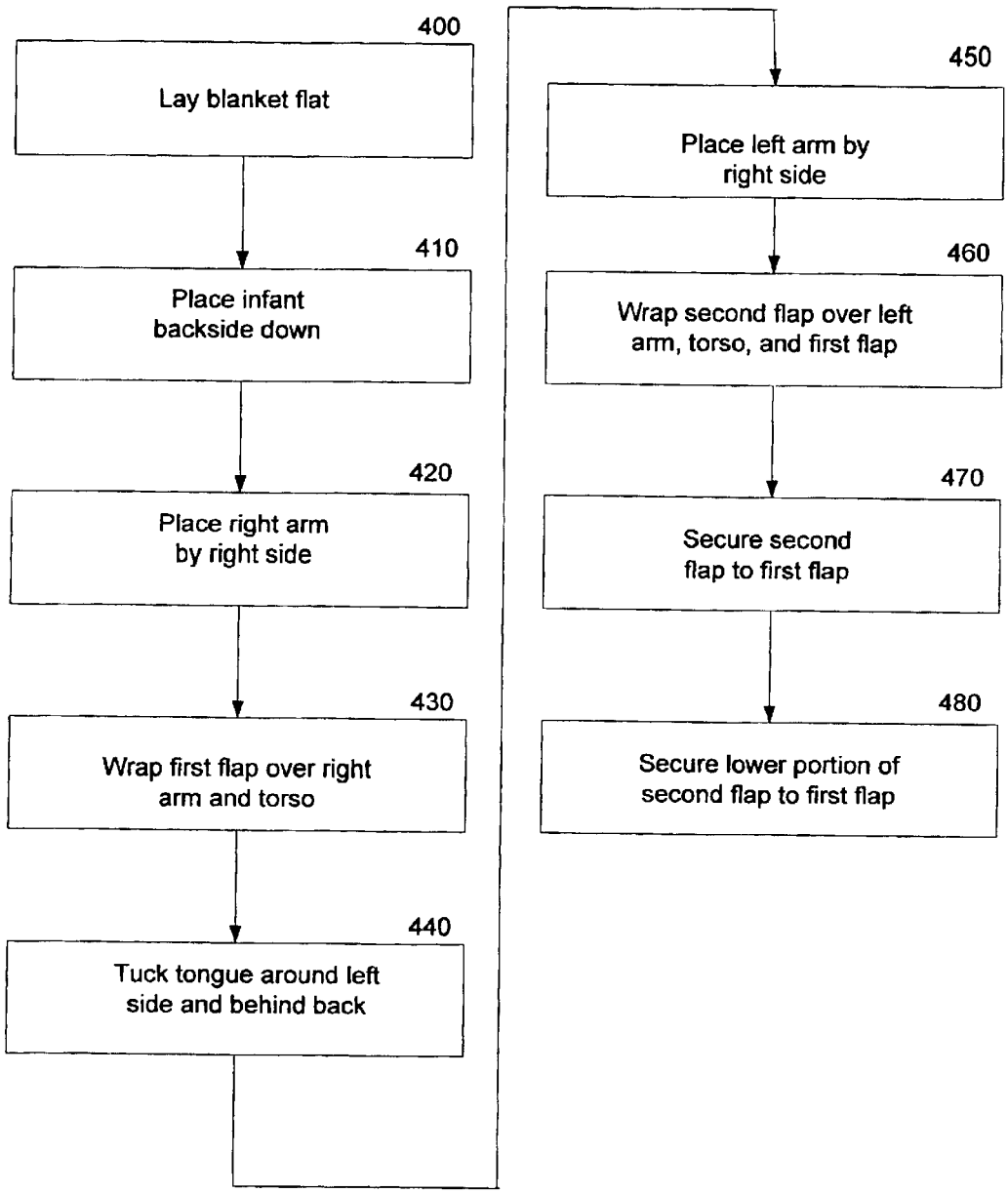
FIG. 5 is a block diagram illustrating a right-handed method of wrapping an infant in a right-handed blanket.

FIG. 5 is a block diagram illustrating a right-handed method of wrapping an infant in a right-handed blanket having a central receiving section for engaging the infant's neck and shoulders; a first flap to the left of the central section; a tongue extending from the upper left side of the first flap; and a second flap extending to the right of the central section.

At step 400, the blanket is layed flat with a receiving surface facing upwards. At step 410, the infant is placed backside down on the central section of the blanket. At step 420, the infant's right arm is placed against the infant's right side. At step 430, the first flap is wrapped over the infant's right arm and torso. At step 440, the tongue is tucked around the infant's left side and under the armpit and across the infant's back. At step 450, the infant's left arm is placed next to the infant's left side. At step 460, the second flap is wrapped over the left arm, torso, and first flap. At step 470, the upper portion of the second flap is secured to the first flap with hook and loop fasteners. At step 480, the lower portion of the second flap is secured to the first flap with a fastener means.

DETAILED DESCRIPTION OF EMBODIMENT

Two Flap Embodiment

Figure 6:
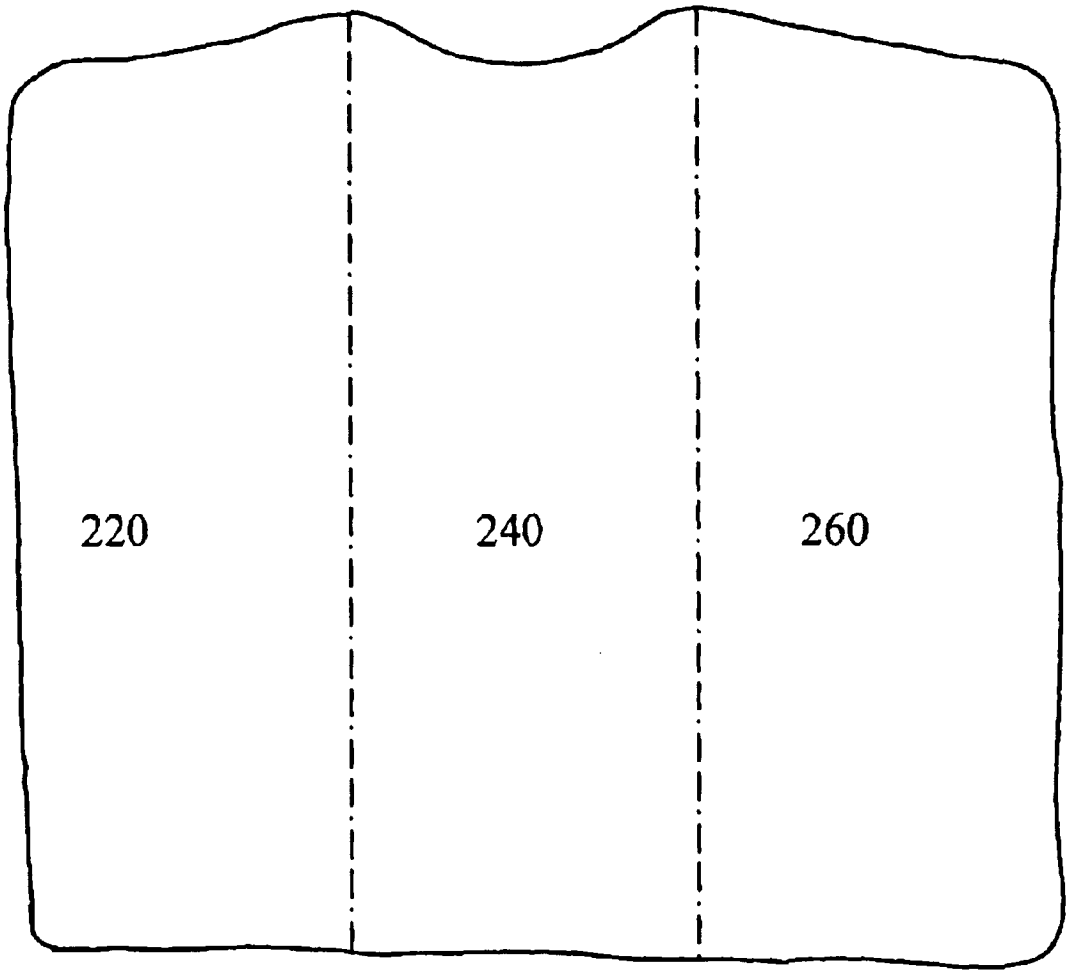
FIG. 6 is a top view of the inner surface of an unfolded blanket illustrating regions of a blanket with a central section, a first flap, and a second flap.

Referring now to FIG. 6, a blanket is provided with a central section 240, a first flap 220, and a second flap 260. In this embodiment, there is not a tongue section. The upper portion of the first flap is wrapped over the infant and behind the infant's back.

What is claimed is:

1. An infant swaddle blanket comprising:

a central section comprising a first side and a second side, and an inner surface and an outer surface;

a first flap extending sidewardly from the central section first side;

a second flap extending sidewardly from the central section second side;

a first curved shoulder seam at the upper portion of the intersection of the first flap and the central receiving section;

a second curved shoulder seam at the upper portion of the intersection of the second flap and the central receiving section; and a tongue extending sidewardly from the first flap.

2. The swaddle blanket of claim 1 further comprising at least one hook and loop closure means for securing the second flap to the first flap.

3. The swaddle blanket of claim 1 further comprising a means for securing the bottom portion of the second flap to the bottom portion of the first flap.

4. The swaddle blanket of claim 1 wherein the central section, the first flap, and the second flap comprise a breathable fabric.

5. The swaddle blanket of claim 4 wherein the breathable fabric further comprises a inner surface liner layer; and an outer surface layer.

6. The swaddle blanket of claim 1 wherein the central section, the first flap, and the second flap comprise a flannel material.

7. The swaddle blanket of claim 1 wherein the central section has a top edge which is elasticized, and the elasticized top edge extends in a first direction along a portion of a top edge of the first flap, and extends in a second direction along a portion of a top edge of the second flap.

8. The swaddle blanket of claim 1 wherein at least a portion of the outer surface of the central section is a skid-resistant material.

9. An infant swaddle blanket comprising:

a central section comprising an inner surface, an outer surface, a top edge, a bottom edge, a first side, and a second side;

a first flap comprising
an inner surface, an outer surface, a first side,
a second side integral to the central section first side,
a top edge, and
a bottom edge;

a tongue integral to the first flap first side, the tongue comprising
an inner surface, an outer surface, and an edge; and a second flap comprising
an inner surface,
an outer surface,
a first side integral to the central section second side,
a second side having a second edge,
a top edge, and
a bottom edge;

a first curved shoulder seam extending alone a portion of the top edge of the central receiving section and a portion of the first flag top edge; and a second curved shoulder seam extending along a portion of the top edge of the central receiving section and a portion of the second flag top edge.

10. The swaddle blanket of claim 9 further comprising at least one hook and loop closure means for securing the second flap to the first flap.

11. The swaddle blanket of claim 9 further comprising a means for securing the bottom portion of the second flap to the bottom portion of the first flap.

12. The swaddle blanket of claim 9 wherein the central section, the first flap, the tongue, and the second flap comprise a breathable fabric such as cotton.

13. The swaddle blanket of claim 12 wherein the breathable fabric further comprises a inner surface liner layer; and an outer surface layer.

14. The swaddle blanket of claim 9 wherein the central section, the first flap, the tongue, and the second flap comprise a flannel material.

15. The swaddle blanket of claim 9 wherein the central section top edge is concave.

16. The swaddle blanket of claim 9 wherein the central section top edge is elasticized, and the elasticized top edge extends in a first direction along a portion of the top edge of the first flap, and extends in a second direction along a portion of the top edge of the second flap.

17. The swaddle blanket of claim 9 wherein the tongue is rounded and can be wrapped under an infant positioned in the central section, such that the tongue extends approximately from the infant's armpit to the infant's thigh.

18. The swaddle blanket of claim 9 wherein at least a portion of the outer surface of the central section is a skid-resistant material.

19. The swaddle blanket of claim 9 wherein a first portion of the outer surface of the first flap is a hook and loop fastening material; and a second portion of the outer surface of the second flap is a hook and loop fastening material, such that roll restriction devices may be removable attached to the first portion and the second portion after swaddling an infant.

20. The swaddle blanket of claim 9 wherein the width between the first curved shoulder seam and the second curved shoulder seam is about 8 to 10 inches;

the combined width of the tongue, first flap, central section, and second flap is about 34 to 41 inches; and the central portion has a length of about 26 to 28 inches.

21. A method of swaddling an infant in an asymmetrical swaddle blanket, the infant having a head, a neck, a torso, a first arm in proximity to a first side, a second arm in proximity to a second side, and a back, the method comprising:

providing an infant swaddle blanket comprising
a central section comprising
a first side, and
a second side;
a first flap comprising
a first side, and
a second side integral to the central section first side,
a tongue integral to the first flap first side; and
a second flap comprising
a first side integral to the central section second side, and
a second side;

placing an infant back down in the central section, such that the head extends above the top edge of the central section;

positioning the first arm by his first side, the first arm being the arm adjacent to the first flap;

folding the first flap over the first arm and the torso;

folding the tongue under the second arm with a portion of the tongue placed between the infant's back and the inner surface of the central portion;

positioning the second arm by his second side;

folding the second flap over his second arm, torso, and first flap, thereby providing a swaddling effect; and securing the second flap with respect to the first flap.

22. The method of claim 21 further comprising removable attaching a first roll restriction device to the first side of the swaddled infant; and removable attaching a second roll restriction device to the second side of the swaddled infant.

* * * * *